United States Patent [19]

Kawakami et al.

[11] 4,287,450

[45] Sep. 1, 1981

[54] ELECTRIC CIRCUIT ARRANGEMENTS INCORPORATING CATHODE RAY TUBES

[76] Inventors: Nidehiko Kawakami; Jun Nishida, both of No. 4896, Aza Ohtani, Ikuta, Kawasaki City, Japan

[21] Appl. No.: 739,868

[22] Filed: Nov. 9, 1976

Related U.S. Application Data

[63] Continuation of Ser. No. 532,161, Dec. 12, 1974, Pat. No. 3,910,498.

[30] Foreign Application Priority Data

May 20, 1974 [JP] Japan ..... 49/57079

[51] Int. Cl.[3] ..... H01J 29/46; H01J 29/56

[52] U.S. Cl. ..... 315/14; 313/449

[58] Field of Search ..... 315/14, 15, 16, 382, 315/31 TV; 313/449

[56] References Cited

U.S. PATENT DOCUMENTS

| | | | |
|---|---|---|---|
| 2,825,837 | 3/1958 | Dudley | 313/82 |
| 2,935,636 | 5/1960 | Knechtli | 313/82 |
| 3,417,199 | 12/1968 | Yoshida et al. | 178/7.2 |
| 3,995,194 | 11/1976 | Blacker, Jr. et al. | 313/449 |

*Primary Examiner*—Theodore M. Blum

*Attorney, Agent, or Firm*—Robert E. Burns; Emmanuel J. Lobato; Bruce L. Adams

[57] ABSTRACT

An electron gun assembly of a cathode ray tube comprises in the order named, a cathode, an apertured modulator electrode, a first and a second apertured anode and a third cylindrical focussing anode. The modulator electrode and the first anode are supplied with such potentials as to form a crossover of electrons therebetween and the second anode is supplied with such a lower positive potential than at the adjacent first and third anodes that the electron stream emitted from the cathode is formed into a narrow beam of electrons and is allowed to enter the third anode at a small angle of beam spread and comes to a focus on the screen of the tube by the third anode to produce a spot of small cross-sectional area.

3 Claims, 13 Drawing Figures

ELECTRIC CIRCUIT ARRANGEMENTS INCORPORATING CATHODE RAY TUBES

This is a continuation of application Ser. No. 532,161, filed Dec. 12, 1974 U.S. Pat. No. 3,910,498.

The present invention relates to electric circuit arrangements of the kind incorporating and arranged for the operation of cathode ray tubes of the type having a sealed evacuated envelope consisting of a bulb portion formed in the approximate shape of a truncated cone and a cylindrical neck portion extending substantially axially from the narrower end of the bulb portion, and containing an electron gun assembly, located within the neck portion, for producing a density-modulated stream of electrons, a phosphor screen carried within the bulb portion, at which the electron stream is directed to produce a spot of small cross-sectional area. More particularly, it relates to the operation of cathode ray tubes of the above-described type having an electron gun assembly of the type having a cathode, a modulator electrode for controlling the intensity of the electron stream, a first anode for accelerating the electrons, a second anode and a focussing system for focussing the electron stream into a beam which impinges on the phosphor screen to produce a spot of small cross-sectional area.

In cathode ray tubes of the type designed for television reception, the electrode assembly comprises, in the order named, a cathode, a modulator electrode for controlling the intensity of electron stream, an anode for accelerating the electrons and a focussing system which usually consists of one or more cylindrical electrostatic lenses for focussing the electron stream into a narrow beam of electrons. The electron gun so constructed is operated such that the anode is supplied with a low voltage of the range between 200 and 450 volts and the focussing system of, for example, a bi-potential type which consists of two cylindrical electrostatic lenses is maintained at a potential of 4 to 5.5 kilovolts at the beam entry side and at a potential of 20 to 30 kilovolts at the beam leaving side of the system. The electron beam first converges to form an electron crossover point between the modulator electrode and the anode, diverges to a larger diameter, and then pre-focussed by the electrical field between the anode and the focussing system and enters the focussing system at a great angle of beam spread until it reaches a region where a final focussing lens is formed, the beam subsequently being caused to converge so as to come to a focus on the phosphor screen and produce a spot of small cross-sectional area. Since the beam enters the focussing system at a large angle of beam spread, the cross-sectional area of the beam in the midst of the focussing system occupies a substantial area of the cross-section of the system and a spot of large cross-sectional area will result due to the spherical aberrations of the system, and so-called "blooming" occurs when the beam current increases.

The increment of the beam spot size is a function of the beam spread angle and of the spherical aberrations of the main focussing system. The relation between these factors is given by the following equation:

$$\Delta r_{sp} = M \cdot C_s \cdot \theta^3$$

where, $\Delta r_{sp}$ is the increment, M, the magnification factor of the main focussing system, $C_s$, the coefficient of spherical aberrations of the system, and $\theta$, the angle of beam spread. On the other hand, the angle of beam spread increases with the beam current and therefore, the beam spot size increases at a higher rate for large beam current than for small beam current. It follows from this that a reduction in the beam spread angle in the beam entry region of the focussing system will result in a reduction in the beam spot size for large beam current. This is particularly important for the design of a color television cathode ray tube which requires a large beam current.

One form of reducing the beam spread angle employs an intercepting electrode having a beam limiting aperture to limit the cross-section of the electron beam passing therethrough. This apparently has a drawback in that it wastes a substantial portion of the usable electrons which would be otherwise focussed on the phosphor screen.

In an alternative form of reducing the beam spread angle, the focussing system is maintained at a higher potential with respect to the anode so as to enhance the pre-focussing effect. However, this results in an increase in the axial length of the focussing system which will cause a halo to appear at the periphery of the beam spot.

In color television cathode ray tubes of the shadow mask type, there is provided a set of three electron gun assemblies, each for producing a beam of electrons for the particular color dot on the screen. It is therefore necessary that the focussing potential of each electron gun assembly must remain substantially constant over the operating range of the beam current while maintaining the beam spot size to a minimum determined by the particular beam current. This is called focus tracking characteristic.

Therefore, an object of the invention is to provide a narrow electron beam of increased intensity.

Another object is to reduce the angle of beam spread in the beam entry region of the focussing system of an electron gun assembly.

A further object of the invention is to provide an electron gun assembly with improved focus tracking characteristic.

In accordance with the present invention, there is provided an electric circuit arrangement of the kind referred to wherein the electron gun assembly of the cathode ray tube comprises, in the order named along the axis of the tube, a cathode, an apertured modulator electrode located close to the cathode for controlling the intensity of the electron stream, a first anode in the form of an apertured metal member located close to the modulator, an apertured second anode located close to the first anode and a third cylindrical focussing anode adjacent to the second anode, said electron being of such configuration, and arranged to be maintained at such potentials in operation of the arrangement that the electron stream from the cathode is formed into a crossover between the modulator electrode and the first anode, said second anode being maintained at such a lower potential than the potentials applied to the first and third anodes that said electron stream is narrowed at a region adjacent to the third anode by the electric fields between the first and second anodes and the second and third anodes and is allowed to enter the third anode at a small angle of beam spread and is focussed thereby into a narrow beam of electrons whose cross-section on the screen of the tube is small.

The invention will be further described with reference to the accompanying drawings, in which.

Figure 1:
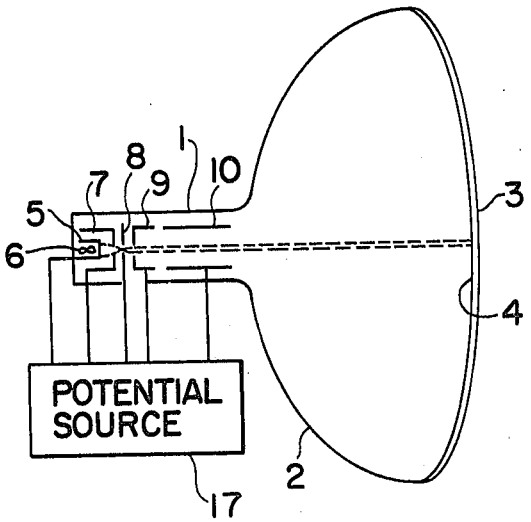
FIG. 1 is a schematic circuit arrangement in accordance with the invention.

Referring now to FIG. 1, the illustrated structure includes a cathode ray tube having an envelope consisting of a cylindrical glass neck portion 1 and conical bulb portion 2 in the approximate shape of a hollow truncated cone closed by a glass faceplate 3 on the inner surface of which is formed a phosphor screen 4.

The neck portion 1 houses the electrode assembly consisting of a thermionic cathode 5 with heater 6, an apertured modulator or control electrode 7 and the focussing means provided in accordance with the invention, consisting of an apertured metal member first anode 8, a second anode 9 which may be in the form of a plate or a cup as shown and a main focussing system 10 which may be a cylindrical focussing lens system such as uni-potential, bi-potential or tri-potential type. The electrodes within the neck 1 are connected through leads passing out through the envelope to a potential source 17 for supplying them with the necessary operating potentials. These potentials are such that electrons emitted from the cathode 5 are, as indicated by the dotted lines representing the electron stream (the diameter of the stream being shown exaggerated for the purposes of illustration), formed into a crossover at a region between the modulator electrode 7 and the first anode 8.

In accordance with the present invention, the second anode 9 is maintained at a potential lower than the potentials applied to the first anode 7 and the focussing system 10. The invention will be described in more detail with reference to FIG. 2 which shows, for example, a bi-potential type focussing system consisting of a third anode 11 and a fourth anode 12. Specifically, the first anode 8 is maintained at a potential in the range of about 600 to 1,200 volts, preferably from 800 to 1,000 volts, the second anode 9 being maintained at between 200 and 400 volts, a third anode 11 being at a potential of 4,000 to 7,000 volts and a fourth anode 12 at 20,000 to 30,000 volts. It was shown in an experiment that with the second anode 9 being at such a lower potential than the potentials applied to the first and third anodes, electrical fields of sharp potential gradient are formed between the first and second anodes and the second and third anodes. With these electrical fields, the stream of electrons subsequent to the crossover point diverges to a larger diameter until it reaches the midpoint region between the second anode 9 and the third anode 11 and then converges to a narrow beam of electrons and enters the third electrode 11 at a small angle ($\theta$) of beam spread. This convergence of electrons at the beam entry region of the third anode 11 is found to be a function of the ratio of the potential applied to the second anode 9 to the potential applied to the first anode 8 and of the ratio of the potential applied to the third anode 11 to the potential applied to the second anode 9.

The lowering of potential at the second anode 9 with respect to the first and third anodes thus produces a narrowed beam of electrons which slightly diverges and then is caused to converge by the electric field between the third anode 11 and the fourth anode 12 and remains of substantially constant cross-section from that region to the phosphor screen 4.

The ratio of potential at the second anode to that applied to the first anode suitable for television reception is found to be in the range from 1:1.5 to 1:6.0 preferably from 1:2.0 to 1:5.0. On the other hand, the ratio of potential applied to the third anode to that applied to the second anode is variable from one cathode ray tube to another, because the potential at the third anode will vary according to the screen size. However, the preferred range of the latter ratio is found to be from 1:0.03 to 1:0.1.

It is also found that the aperture diameter of the second anode 9 should be greater than that of the first anode 8 and the preferred ratio of the former to the latter is in the range between 1.5:1 and 3:1.

Figure 9:
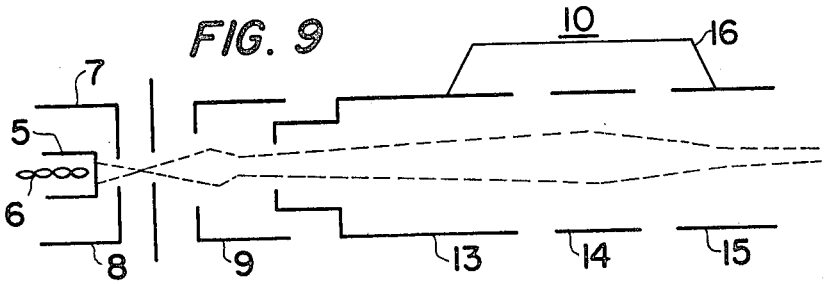
FIG. 9 is a schematic cross-sectional view of a uni-potential type electrode assembly in accordance with the invention.

A uni-potential type electrode assembly is shown in FIG. 9 as an alternative arrangement in which similar components are indicated by similar numbers. The uni-potential type focussing system 10 forms a cylindrical lens system consisting of a third anode 13, a fourth anode 14 and a fifth anode 15 which is maintained at the same potential as at third electrode 13 by electrical connection 16. The electrode 14 is maintained at a much lower potential than the third and fifth anode.

The second anode 9 is maintained at such a lower potential than the first anode 8 and third anode 13 that the electron stream is formed into a beam of small cross-sectional area and enters the third anode 13 at a small angle of beam spread. The preferred ratio of potential applied to the second anode 9 to the potential applied to the first anode 8 is found to be in the range from 1:1.5 to 1:6.0, and the preferred ratio of potential applied to the third anode 13 to that applied to the second anode 9 is found to be in the range from 1:0.006 to 1:0.04.

The aperture diameter ratio of the second anode 9 to the first anode 8 should also be in the range of 1.5:1 and 3:1 as in the bi-potential type electrode assembly.

The fact that the lowering of potential at the second anode with respect to the first and third anodes results in a beam of electrons entering at a reduced angle of beam spread with increased electron density is found to be particularly advantageous when the electrode assembly is operated at a large beam current as in the case of color television reception.

The invention will be further described with reference to the bi-potential type electrode assembly by way of the following examples to determine the operating range of the electrodes to achieve the intended result. The structural dimensions of the electrode assembly are only an example and may be varied. Although the operating parameters of the electrode assembly will vary according to the structural dimensions of the assembly, the operating range of the electrodes is the optimum values regardless of the structural dimensions in so far as one can obtain a beam spot of the minimum cross-sectional area required for a particular dimension.

EXAMPLE I

The bi-potential type electrode assembly has the following structural parameters:

| | |
|---|---|
| Aperture diameter of modulator electrode ($D_m$) | 0.5 mm |
| Aperture diameter of 1st anode ($D_1$) | 0.8 mm |
| Aperture diameter of 2nd anode ($D_2$) | 1.0 mm |
| Apertuter diameter of 3rd anode ($D_3$) | 2.0 mm |
| Thickness of modulator electrode (1) | 0.1 mm |
| Spacing between cathode and modulator electrode | 0.1 mm |
| Spacing between modulator electrode and 1st anode | 0.5 mm |
| Spacing between 1st and 2nd anodes | 0.5 mm |
| Spacing between 2nd and 3rd anodes | 3.0 mm |

Figure 3:
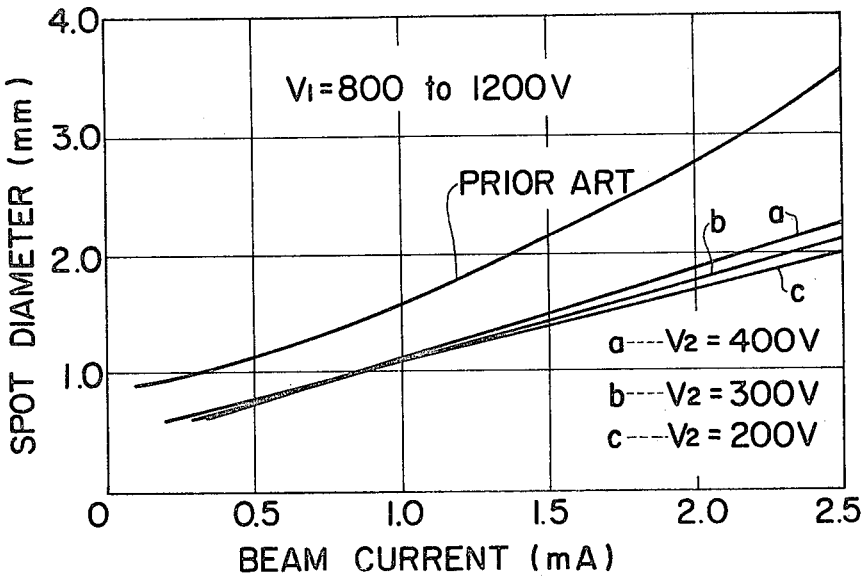
FIGS. 3 and 4 are graphs showing spot diameter versus beam current characteristics of the bi-potential type electrode assembly.

With these parameters, the following potentials were applied to these electrodes:

$V_c=0$
$V_m=-150$ volts (cut-off)
$V_1=800$ to 1,200 volts
$V_2=200$ to 400 volts
$V_3=6{,}000$ to 6,800 volts
$V_4=20{,}000$ to 30,000 volts where, $V_c$, $V_m$, $V_1$, $V_2$, $V_3$ and $V_4$ are the potentials applied to the cathode 5, modulator 7, first anode 8, second anode 9, third anode 11 and fourth anode 12 respectively. The second anode potential $V_2$ was varied from 200 to 400 volts, that is, the ratio of $V_2$ to $V_1$ was varied from 1:2.0 to 1:6.0 to obtain the minimum spot size for a particular beam current which was varied up to 2.5 milliamperes. The minimum beam spot size varied from 0.6 mm to 2.2 mm in diameter, as shown in FIG. 3.

In order to obtain the minimum beam spot size for the varying beam current, the potential at the third anode was adjusted in the range from 6,000 to 6,800 volts. This range of adjustment represents the focus tracking characteristic of the electrode assembly. As shown in the solid-line curves of FIG. 5, the range of adjustment is substantially constant over the beam current of up to 2.5 milliamperes.

Figure 2:
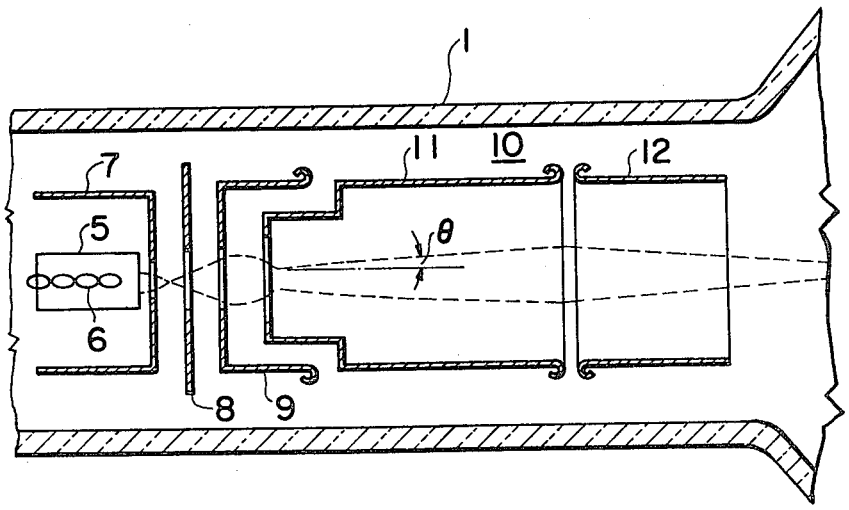
FIG. 2 is a schematic but detailed cross-sectional view of a bi-potential type electrode assembly of a cathode ray tube of the invention suitable for use in the circuit arrangement in accordance with the invention.

For comparison purposes, a conventional electron gun assembly of the bi-potential type similar to that shown in FIG. 2 of the application except that the second anode 9 is excluded is tested. The conventional electrode assembly has the following structural parameters:

| | |
|---|---|
| Aperture diameter of modulator electrode | 0.7 to 0.75 mm |
| Aperture diameter of 1st anode | 0.7 to 0.75 mm |
| Aperture diameter of 3rd anode | 2.0 mm |
| Thickness of modulator electrode | 0.1 to 0.15 mm |
| Spacing between cathode and modulator electrode | 0.1 to 0.15 mm |
| Spacing between modulator electrode and 1st anode | 2.5 to 4.0 mm |
| Spacing between 1st and 3rd anodes | 0.3 to 0.5 mm |

Potentials applied to these electrodes are as follows:

$V_c=0$
$V_m=-100$ volts (cut-off)
$V_1=200$ to 450 volts
$V_3=4{,}000$ to 5,500 volts
$V_4=20{,}000$ to 30,000 volts With these parameters, the beam current was varied up to 2.5 milliamperes. As a result, spot size (diameter) versus beam current characteristic was obtained as shown in FIG. 3, and compared favorably with the prior art which amounts to a reduction in the beam spot size of substantially 40%.

Figure 12:
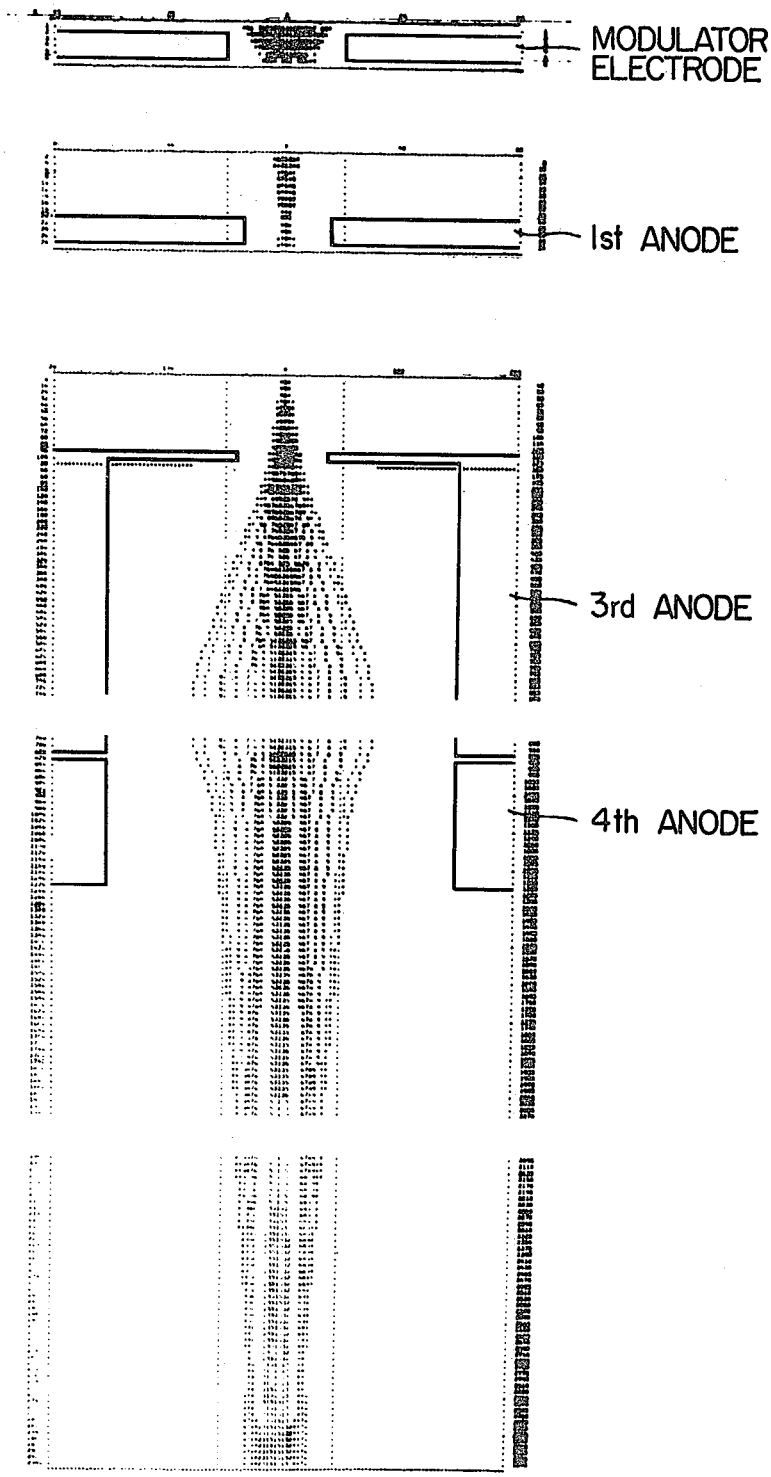
FIG. 12 shows the trajectory of the electron stream travelling through the prior art bi-potential type electrode assembly in a simulation test using an IBM-370 computer.
Figure 13:
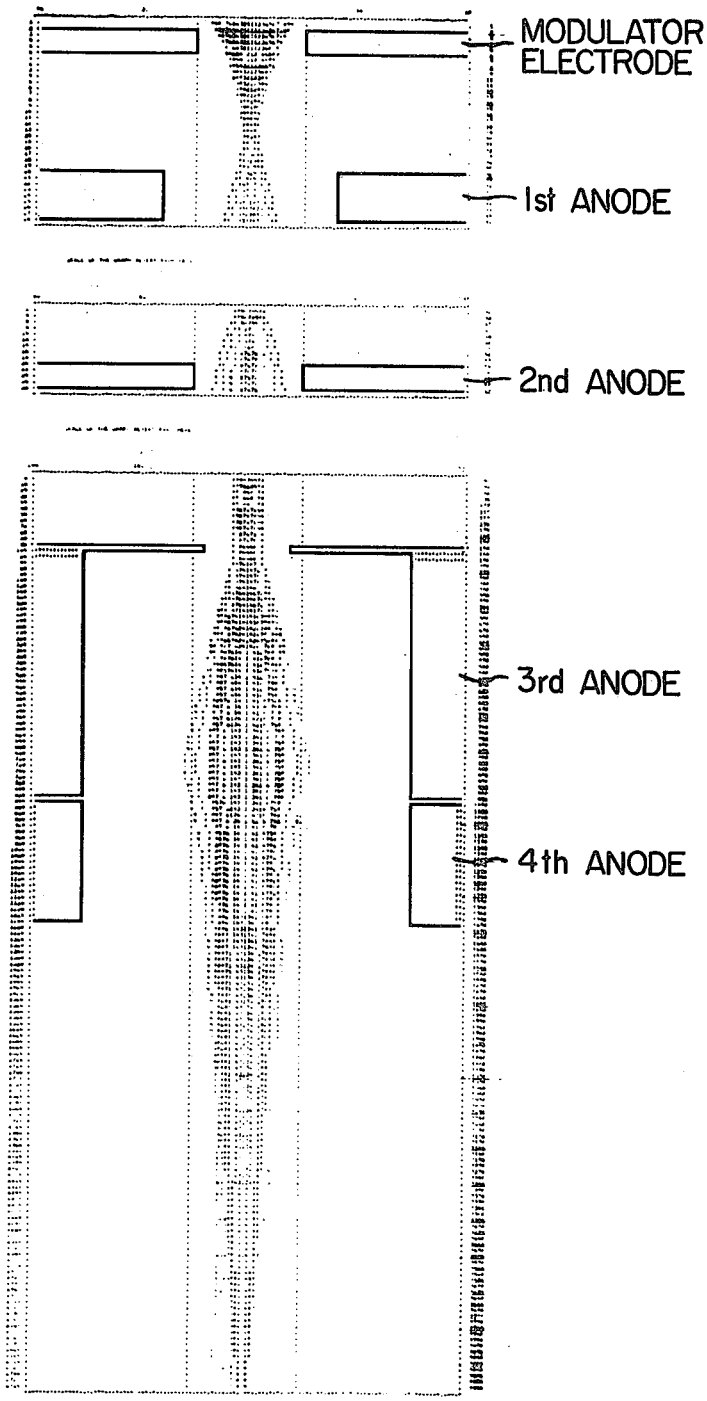
FIG. 13 shows the trajectory of the electron stream travelling through the bi-potential type electrode assembly of the invention in a simulation test using the same computer.

Simulation tests were conducted using an IBM-370 computer in respect of both the prior art and the present electrode assemblies for a beam current of 2.5 milliamperes to determine the trajectory of the electron streams of the two assemblies. Results are shown in FIGS. 12 and 13. In FIG. 12 the aperture diameter of the first anode is scaled down to 1/2 compared with the modulator electrode and the third anode is scaled down to 1/2.5 compared with the first anode. Similarly, in FIG. 13, the aperture diameter of the second anode is scaled down to 1/2 and the third anode is scaled down to 1/2.5 compared with the second anode for purposes of clarification. It is appreciated that in FIG. 13 the electron beam enters the focussing system consisting of the third and fourth anodes at a small angle of beam spread. At a region adjacent to the focussing electric field between the third and fourth anodes it diverges to its maximum diameter which is favorably compared with the maximum diameter of the electron beam in the equivalent region of the prior art electrode assembly as shown in FIG. 12. Therefore, it is shown that the electron beam of the invention is less affected adversely by the spherical aberrations of the focussing electrode.

EXAMPLE II

Figure 4:
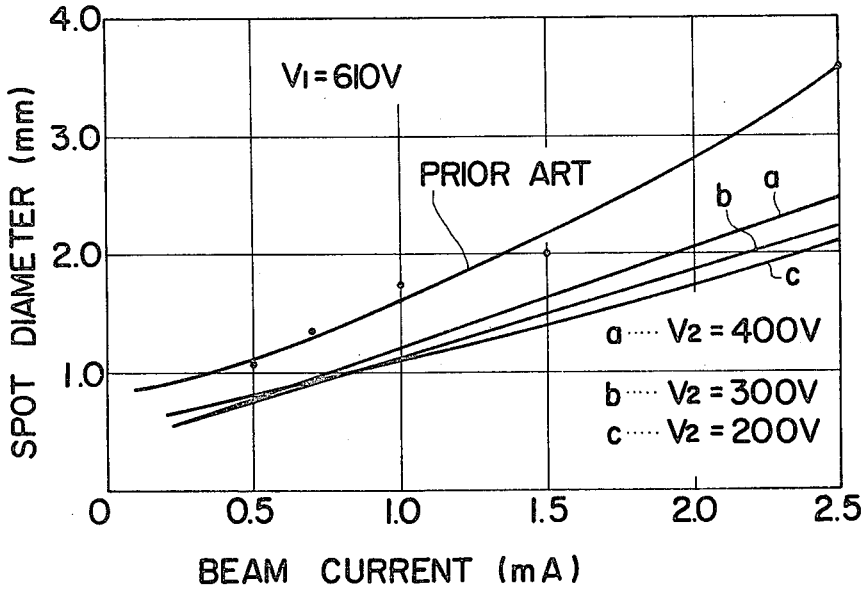
Figure 5:
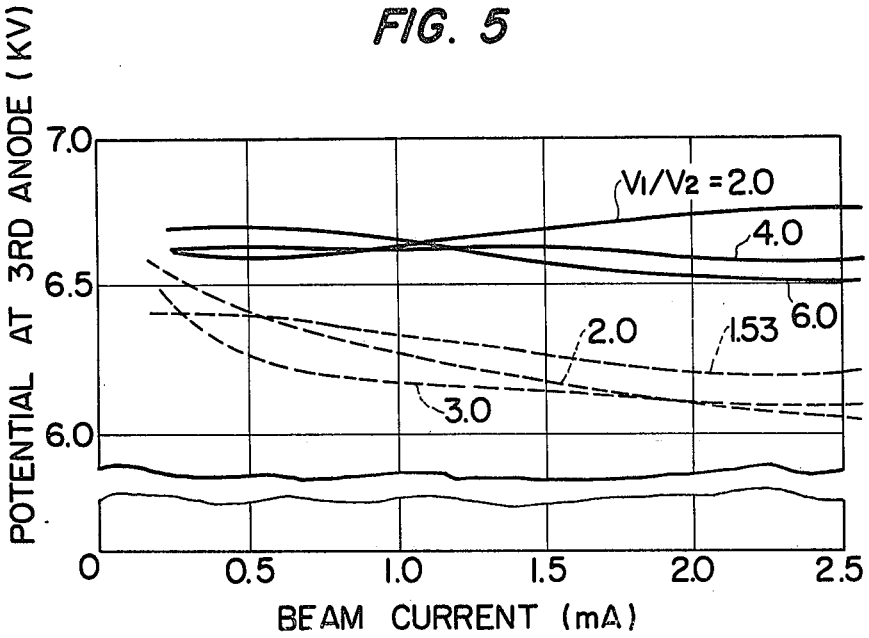
FIG. 5 is a graph showing focus tracking characteristic of the electrode assembly.

A bi-potential type electrode assembly similar in configuration to, but slightly differing in structural dimensions from that used in Example I was operated. The first anode 8 was maintained at 610 volts and the potential at second anode 9 was varied from 200 to 400 volts, with the third anode being maintained at a potential in the range of 6.0 to 6.5 kilovolts. The other parameters were the same as in Example I. In this example, the potential ratio of $V_2$ to $V_1$ was varied from 1:1.5 to 1:3.0. The results are shown in FIGS. 4 and 5. The focus tracking characteristic shown in dotted-line curves in FIG. 5 explains that at the potential ratio of 1:1.53 of $V_2$ to $V_1$ the adjustment ratio of the potential at the third anode 11 is from 6.2 to 6.4 kilovolts. The spot size versus beam current characteristic of the invention with the first anode being maintained at a potential of 610 volts is favorably compared with the prior art as shown in FIG. 4, the curve of prior art being the same as that obtained in Example I. The minimum spot size was from 0.6 to 2.5 mm in diameter.

EXAMPLE III

The angle of beam spread versus beam current characteristic was obtained and compared with the corresponding characteristic of the prior art. The electrode assembly used in Example I was applied with the following potentials:

$V_1$=1,050 volts
$V_2$=280 volts
$V_3$=6,000 volts

The beam current was varied from 0.1 to 2.5 milliamperes.

The electrode assembly of the prior art as used in Example I was applied with the following potentials:

$V_1$=300 volts
$V_3$=5,000 volts

Figure 6:
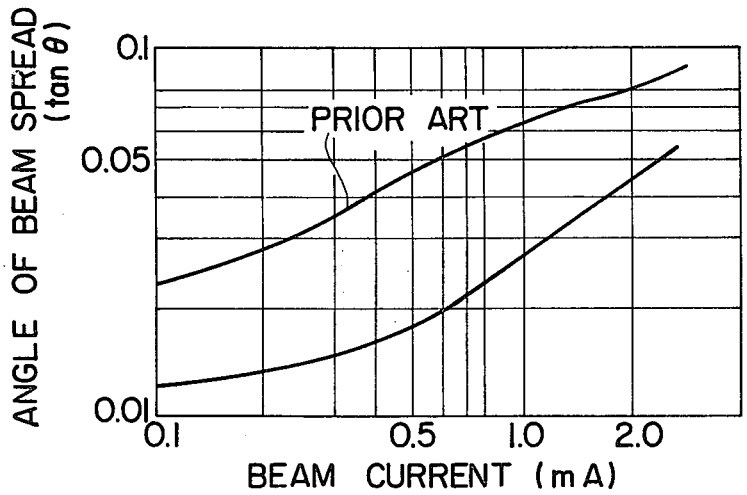
FIG. 6 is a graph showing angle of beam spread versus beam current characteristic of the electrode assembly.

Curves obtained for each of the electrode assemblies are shown in FIG. 6. The angle of beam spread of the present invention is favorably compared with that of the prior art.

EXAMPLE IV

Figure 7:
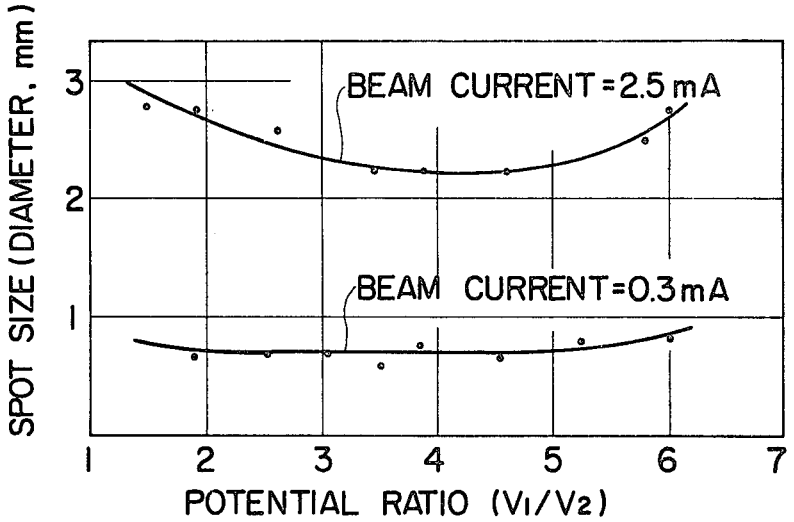
FIG. 7 is a graph showing spot size versus potential ratio characteristics of the electrode assembly.

The variation of beam spot size was measured for a given beam current as the potential ratio of $V_2$ to $V_1$ was varied. As shown in FIG. 7, the spot size remains substantially constant for the beam current of 3.0 milliamperes over the range of potential ratio from 1.5 to 6.0.

EXAMPLE V

Figure 8:
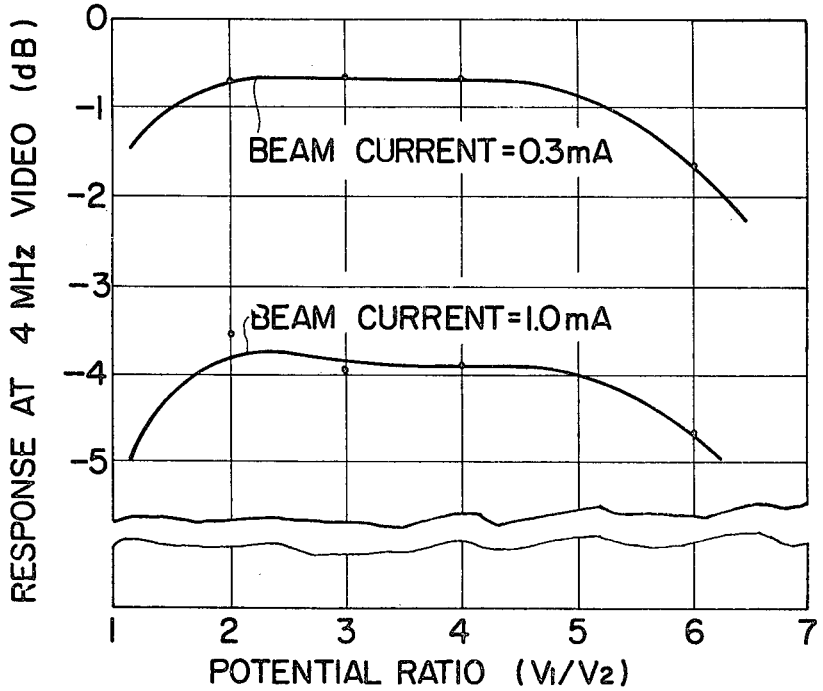
FIG. 8 is a graph showing follow-up response characteristics of the electron beam relative to variation of the ratio of potentials applied to the first and second anodes of the electrode assembly.

The response characteristic of the electron beam at a video frequency of 4 MHz was measured for a given beam current as the potential ratio of $V_2$ to $V_1$ was varied. Sinusoidal wave at a frequency of 4 MHz was applied to the modulator electrode and the $V_2$ to $V_1$ ratio was varied up to 6.0. The amplitude of the beam spot intensity was measured by a photodetector and compared with the amplitude of the original waveform applied to the modulator electrode so as to determine how the follow-up response characteristic of the electron beam at the video frequency of 4 MHz varies with the potential ratio. Data shown in FIG. 8 shows that the ratio of 1.5 to 6.0 ensures good response characteristic.

EXAMPLE VI

The uni-potential type electrode assembly has the following structural parameters:

| | |
|---|---|
| Aperture diameter of modulator electrode | 0.5 mm |
| Aperture diameter of 1st anode | 0.7 mm |
| Aperture diameter of 2nd anode | 1.5 mm |
| Aperture diameter of 3rd anode | 2.0 mm |
| Thickness of modulator electrode | 0.1 mm |
| Spacing between cathode and modulator electrode | 0.1 mm |
| Spacing between modulator electrode and 1st anode | 0.5 mm |
| Spacing between 1st and 2nd anodes | 0.5 mm |
| Spacing between 2nd and 3rd anodes | 3.0 mm |

Figure 10:
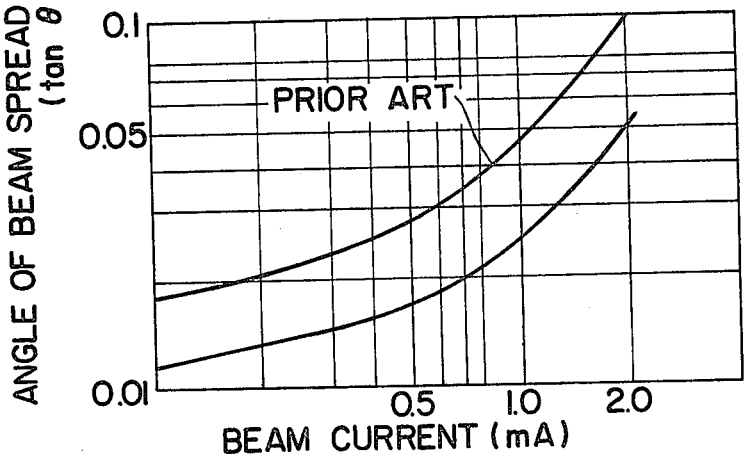
FIG. 10 is a graph showing angle of beam spread versus beam current characteristic of the uni-potential type electrode assembly.
Figure 11:
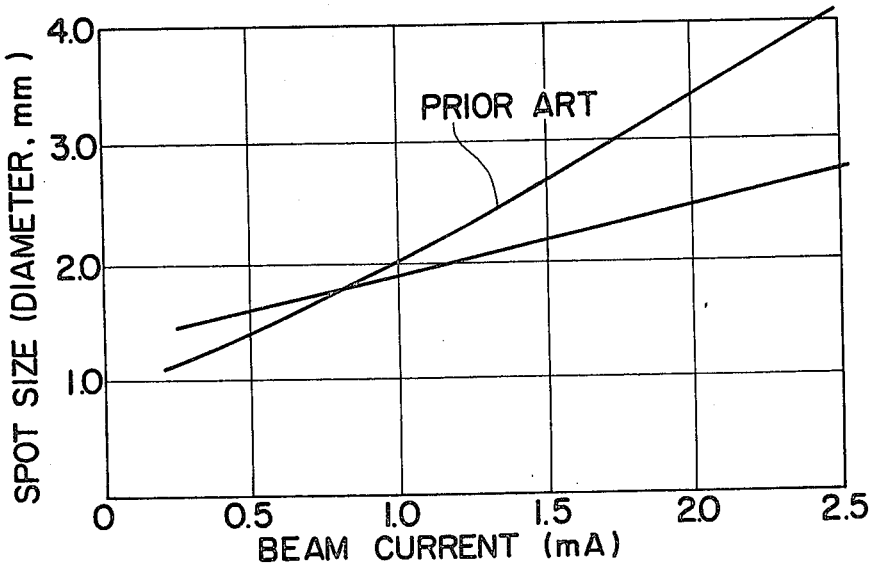
FIG. 11 is a graph showing spot size versus beam current characteristic of the uni-potential type electrode assembly.

With these structural parameters, the following potentials are applied to these electrodes:

$V_c$=0
$V_m$=150 volts (cut-off)
$V_1$=800 to 1,200 volts
$V_2$=150 to 600 volts
$V_3$=15,000 to 25,000 volts
$V_4$=−1,000 to +1,000 volts
$V_5$=15,000 to 25,000 volts where, $V_c$, $V_m$, $V_1$, $V_2$, $V_3$, $V_4$ and $V_5$ are the potentials applied to the cathode 5, modulator 7, first anode 8, second anode 9, third anode 13, fourth anode 14 and fifth anode 15 respectively. The angle of beam spread versus beam current characteristic of the uni-potential type was obtained as shown in FIG. 10. For comparison purposes, the corresponding characteristic of a prior art uni-potential type electrode assembly is plotted on FIG. 10. The reduced beam spread angle for the beam current of 2.0 mm milliamperes ensures that the so called "blooming" can be effectively eliminated when the electrode assembly is operated at a large beam current. The beam spot size versus beam current was obtained and compared favorably with prior art as shown in FIG. 11 which amounts to a reduction in the beam spot size of substantially 30%.

We claim:

1. An electron gun assembly for a cathode ray tube which comprises, in the order named along the axis of the tube, a cathode for emitting in operation an electron stream, an apertured modulator electrode located close to the cathode for controlling the intensity of the electron stream, a first anode in the form of an apertured metal member located close to the modulator electrode, an apertured second anode located close to the first anode and a third cylindrical focusing anode of a unipotential type adjacent to the second anode, said electrodes being of such configuration, and arranged to be maintained at such potentials in operation of the arrangement, that the electron stream from the cathode is formed into a crossover between the modulator electrode and the first anode, means to effect in operation a ratio of potential applied to the second anode to potential applied to the first anode in the range between 1:1.5 and 1:6.0 and the ratio of potential applied to the third anode and to potential applied to the second anode being in the range between 1:0.006 and 1:0.04 so that said electron stream narrowed at a region adjacent to the third anode by the electric fields established between the first and second anodes and the second and third anodes and is allowed to enter the third anode at a small angle of beam spread and is focused thereby into a narrow beam of electrons whose cross-section on the screen of the tube is small.

2. An electron gun assembly as claimed in claim 1, including means to apply a maximum potential to the third unipotential anode substantially in a range from 15 kilovolts to 25 kilovolts.

3. A method of operating a cathode ray tube having a faceplate carrying thereon a phosphor screen, and an electron gun comprising a cathode operable to emit electrons, a modulator electrode positioned adjacent the cathode and having an aperture therethrough for defining an electron stream path along an axis from the cathode through the modulator electrode aperture and toward the screen, a first anode positioned downstream from the modulator electrode and having an aperture along the axis and being of a sufficient dimension to permit the electron stream to pass therethrough without intersecting the first anode, a second anode positioned downstream from the first anode and having an anode aligned with the first anode aperture along the axis and being of a sufficient dimension to permit the electron stream to pass therethrough without intersecting the second anode, and a uni-potential focusing system positioned downstream from the second anode along the axis for focusing the electron stream into a narrow focused beam of electrons and comprising a cylindrical third anode having an axial bore aligned along the axis and dimensioned for permitting the stream of electrons to pass therethrough unobstructed and without intersecting the cylindrical third anode, which method comprises: operating the cathode to emit electrons; relatively biasing said anodes, to form a crossover point in the stream of electrons between the modulator electrode and the first anode while maintaining the ratio of potentials respectively applied to the second and first anodes and the ratio of potentials respectively applied to the third and second anodes within ranges effective to focus the electron stream into a narrow beam of electrons and to focus the crossover point of the electron stream onto the phosphor screen of the tube, maintaining the ratio of potential applied to the second anode to the potential applied to the first anode in the range between 1:1.5 to 1:6.0, and maintaining the ratio of potential applied to the third anode to the potential applied to the second anode in the range between 1:0.006 to 1:0.04.

* * * * *